US005772050A

United States Patent [19]

Shih

[11] Patent Number: 5,772,050

[45] Date of Patent: Jun. 30, 1998

[54] INK STAMP RACK

[76] Inventor: Shiny Shih, No. 31, Lane 349, Chung Cheng S. Rd., Yung Kang City, Tainan Hsien, Taiwan

[21] Appl. No.: 808,464

[22] Filed: Mar. 3, 1997

[51] Int. Cl.[6] ..... A47F 7/00

[52] U.S. Cl. ..... 211/39; 211/163; 211/205; 248/159

[58] Field of Search ..... 211/39, 163, 70, 211/131.1, 144, 205; 248/159, 415

[56] References Cited

U.S. PATENT DOCUMENTS

| | | | |
|---|---|---|---|
| 652,257 | 6/1900 | Folger | 211/39 |
| 1,890,420 | 12/1932 | Smith | 211/205 X |
| 1,900,610 | 3/1933 | Mullins | 248/159 X |
| 4,534,471 | 8/1985 | Zahn et al. | 211/39 |
| 4,865,283 | 9/1989 | Parker | 248/159 |

FOREIGN PATENT DOCUMENTS

| | | | |
|---|---|---|---|
| 63981 | 10/1945 | Denmark | 211/39 |
| 317699 | 1/1902 | France | 211/39 |
| 238700 | 12/1945 | Switzerland | 211/39 |

*Primary Examiner*—Robert W. Gibson, Jr.
*Attorney, Agent, or Firm*—Kirkpatrick & Lockhart LLP

[57] ABSTRACT

A stamp rack includes a base, an inner plate disposed to a bottom of the base, a first post disposed to the base wherein an annular flange and an engaging rod respectively extend radially and longitudinally from a second end of the first post, a first disk mounted to the first post and supported by first flange, a second post securely inserted into the first post by extending a protrusion of the second post through a hole defined in the first end of the first post, a second flange extending radially from the second post so as to support a second disk mounted to the second post and a cap mounted to the second post to position the second disk. Each of the first disk and the second disk has a plurality of Y-shaped recesses defined therein for receiving stamps therein.

6 Claims, 5 Drawing Sheets

INK STAMP RACK

BACKGROUND OF THE INVENTION

1. Field of the Invention

The present utility model relates to a rack and, more particularly, to an ink stamp rack having at least one disk supported by a post which is fixedly connected to a base and a cap connected to the post to position the disk which has a plurality of recesses defined therein such that the ink stamps can be received in the recesses.

2. Brief Description of the Prior Art

Stamps are used in a variety of fields in offices and which are convenient to mark documents with writing or symbols in colored ink. Generally, a clerical worker has many stamps which are stored in a drawer or a box or the like so that they may be selected conveniently. However, storing stamps in a drawer or a box results in abrasion to the stamps and this reduces their lifespan. Furthermore, the drawer and/or the box for the ink stamps received therein will be contaminated by ink on the stamps.

The present utility model intends to provide an ink stamp rack which has at least one disk disposed thereto which has a plurality of recesses defined therein so as to mitigate and/or obviate the above-mentioned problems.

SUMMARY OF THE INVENTION

The present utility model provides an ink stamp rack which comprises a base having a first central hole defined therein and a skirt portion extending downwardly from a periphery thereof.

A first post has a first end having a first flange extending radially therefrom and a first hole defined in the first post beneath the first flange, and a second end which has an annular flange extending radially therefrom and an engaging rod extending longitudinally therefrom. The second end of the first post is connected to the base by engaging the engaging rod with the first central hole of the base.

A first disk has a second central hole defined therein so as to be mounted to the first end of the first post and supported by the first flange. A plurality of first recesses are defined in the first disk along a periphery of the first disk.

A second post has a first end having a second flange extending radially therefrom and a second end which has a first protrusion extending radially from a periphery thereof so as to extend through the first holes of the first post.

A second disk has a third central hole defined therein so as to be mounted to the first end of the second post and supported by the second flange. A cap is mounted to the first end of the second post to position the second disk.

It is an object of the present utility model to provide an ink stamp rack which has a simple structure and is easily to be assembled.

It is another object of the present utility model to provide an ink stamp rack which has two disks disposed thereto.

Other objects, advantages, and novel features of the utility model will become more apparent from the following detailed description when taken in conjunction with the accompanying drawings.

DETAILED DESCRIPTION OF THE PREFERRED EMBODIMENTS

Figure 1:
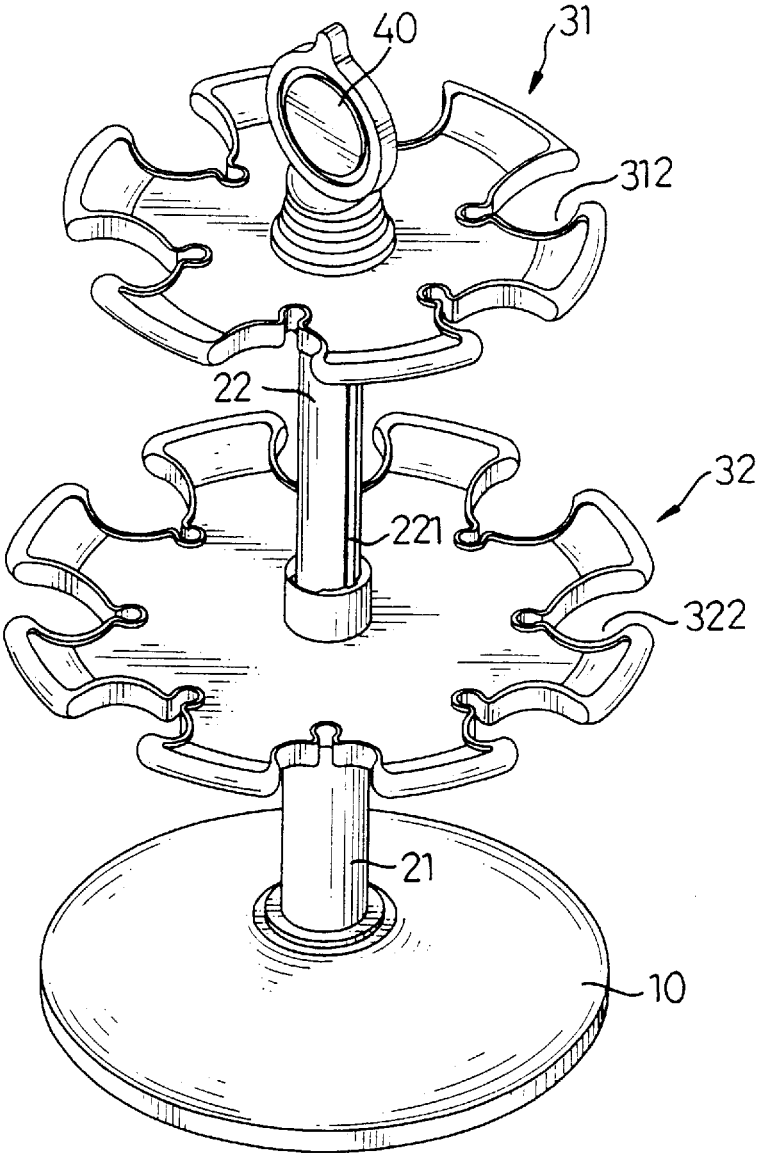
FIG. 1 is a perspective view of an ink stamp rack in accordance with the present utility model.
Figure 2:
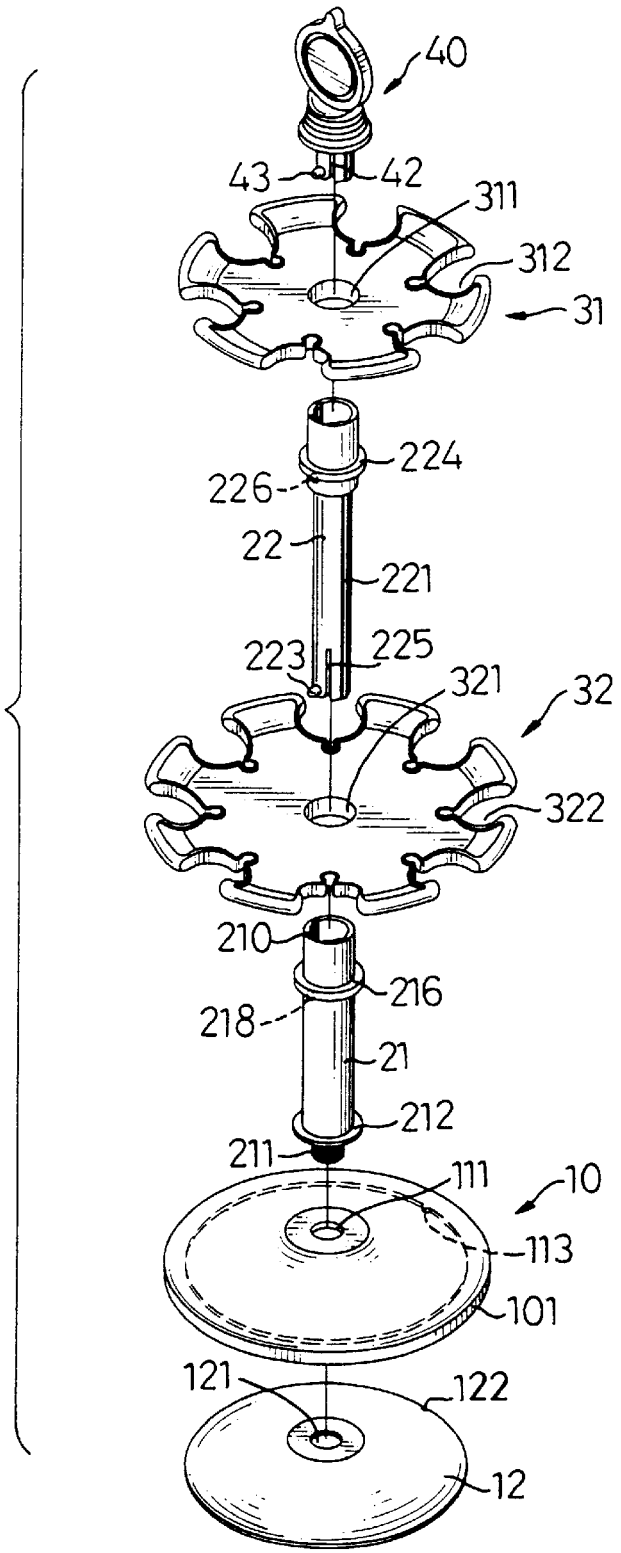
FIG. 2 is an exploded view of the ink stamp rack in accordance with the present utility model.
Figure 3:
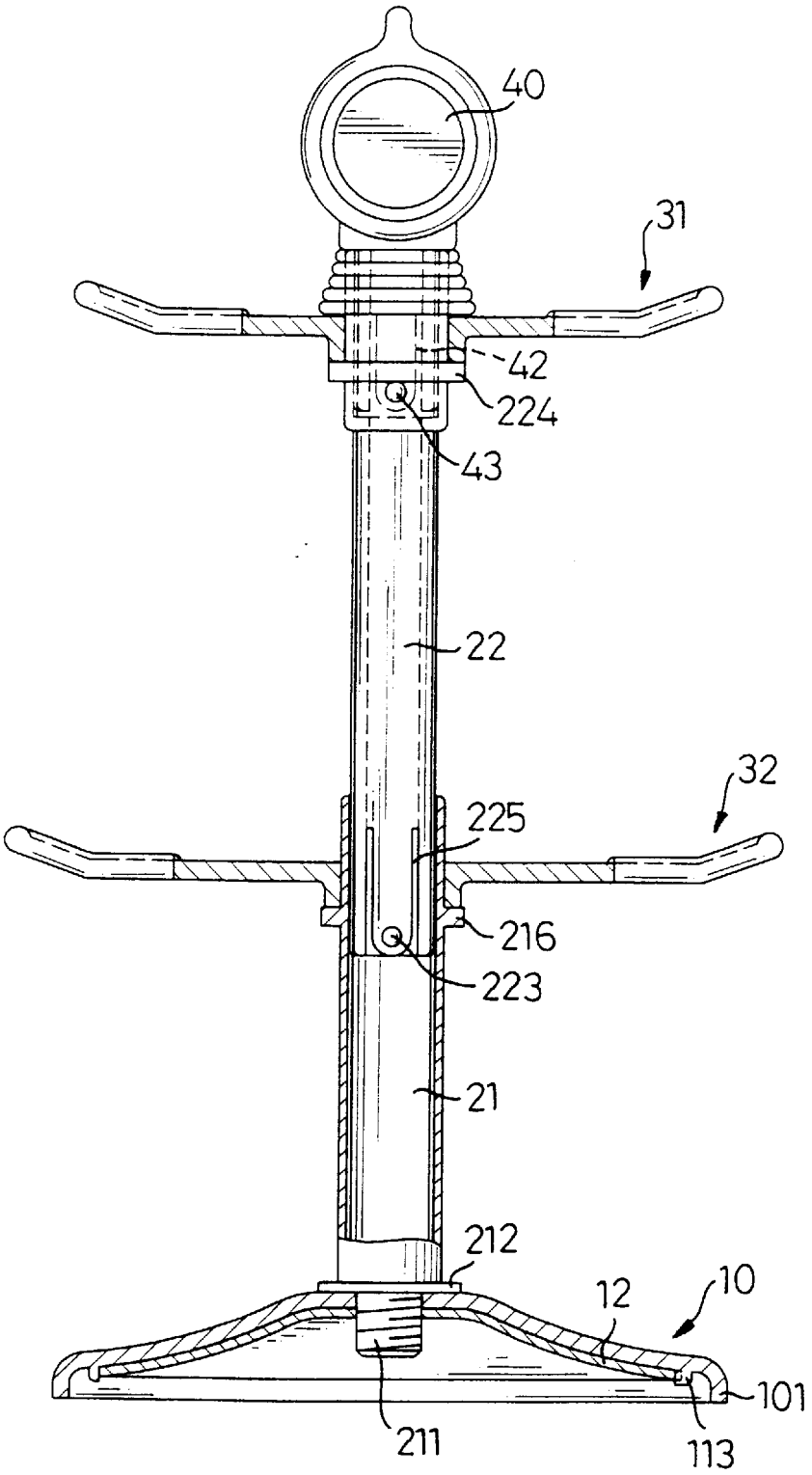
FIG. 3 is a side elevational view, partly in section, of the ink stamp rack in accordance with the present utility model.
Figure 4:
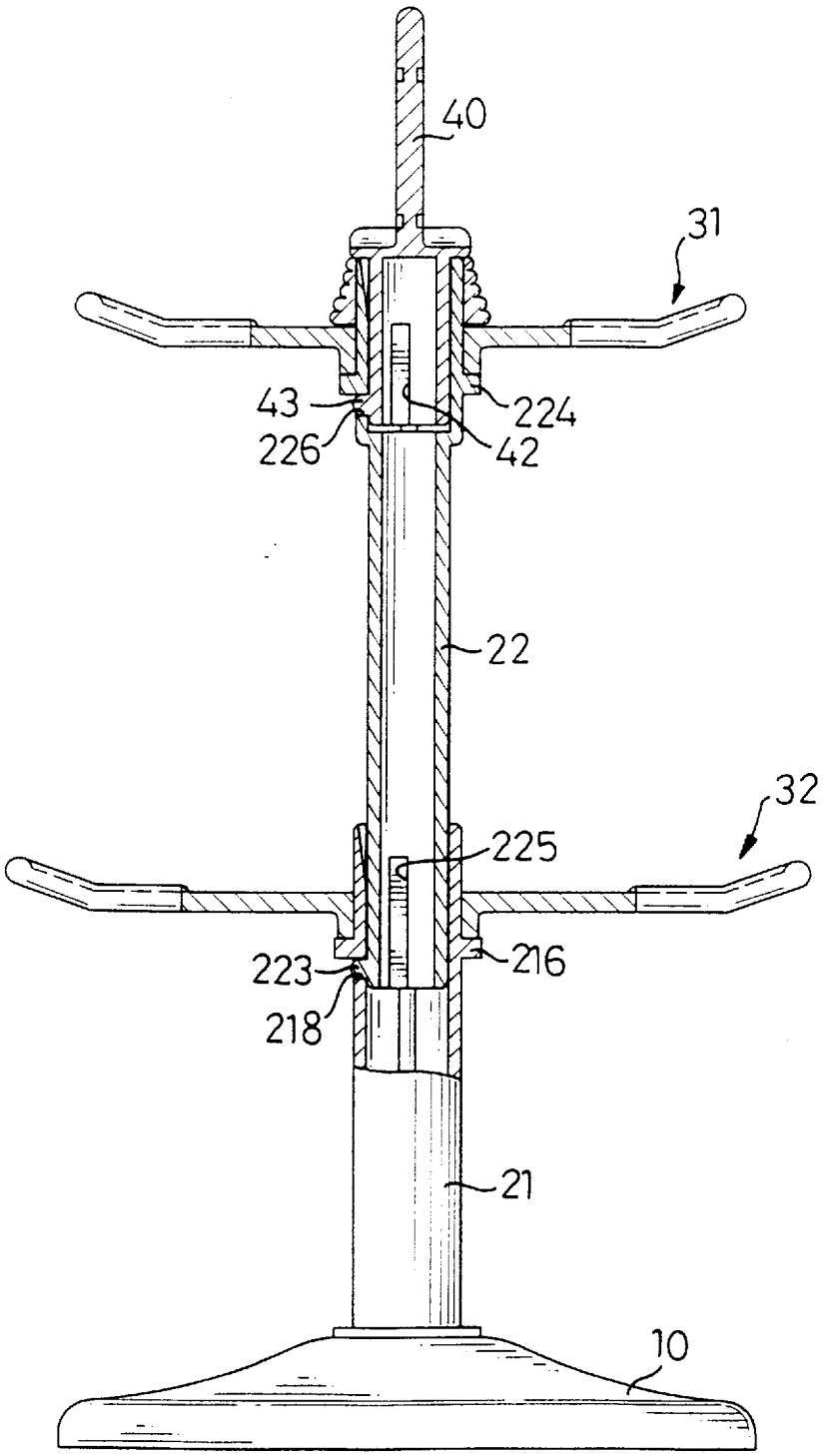
FIG. 4 is a side elevational view, partly in section, of the ink stamp rack in accordance with the present utility model seen from another direction.

Referring to the drawings and initially to FIGS. 1 through 4, an ink stamp rack in accordance with the present utility model generally includes a base 11 having a first central hole 111 defined therethrough and a skirt portion 101 extending downwardly from a periphery thereof. The skirt portion 101 has at least one protrusion 113 extending inwardly and radially therefrom.

A first post 21 has a first end and a second end which has an annular flange 212 extending radially therefrom and an engaging rod 211 extends longitudinally therefrom. The engaging rod 211 has a threaded portion defined in an outer periphery thereof. A first flange 216 extends radially from the first post 21 near the first end of the first post 21 and a first hole 218 is defined in the first post 21 beneath the first flange 216. Two longitudinal grooves 210 are defined longitudinally opposite in an inner periphery of the first post 21. An inner plate 12 is disposed to a bottom of the base 10 and has a central threaded hole 121 defined therethrough such that the threaded portion of the engaging rod 211 is engaged with the threaded hole 121 of the inner plate 12. The inner plate 12 has a notch 122 defined in an outer periphery thereof such that when the inner plate 12 is disposed to the bottom of the base 10, the protrusion 113 is received in the notch 122.

A first disk 32 has a second central hole 321 defined therein so as to be mounted to the first end of the first post 21 and supported by the first flange 216. A plurality of first recesses 322 are defined in the first disk 32 along a periphery thereof and each of the first recesses 322 is a substantially Y-shaped recess.

A second post 22 has a first end and a second end and has two splines 221 extending diametrically opposite therefrom. The second end of the second post 22 has a first protrusion 223 extending radially therefrom so as to extend through the first hole 218 of the first post 21 with the two splines 221 received in the two longitudinal grooves 210 of the first post 21. Two slits 225 are defined longitudinally therein and the first protrusion 223 is located between the two slits 225 so that the first protrusion 223 can be slightly pushed inwardly before it is inserted into the first hole 218. A second flange 224 extends radially therefrom near the first end of the second post 22. The second post 22 has a second hole 226 defined therein beneath the second flange 224.

A second disk 31 has a third central hole 311 defined therein so as to be mounted to the first end of the second post 22 and supported by the second flange 224. A plurality of second recesses 312 are defined in the second disk 31 along a periphery of the second disk 31 and each of the second recesses 312 is a substantially Y-shaped recess.

A cap 40 is mounted to the first end of the second post 22 to position the second disk 31 on the second post 22 wherein the cap 40 has a second protrusion 43 extending radially therefrom such that when the cap 40 is mounted to the first end of the second post 22, the second protrusion 43 extends through the second hole 226. Similarly, two slits 42 are defined longitudinally therein and the second protrusion 43 is located between the two slits 42 so that the second protrusion 43 can be slightly pushed inwardly before it is inserted into the second hole 226. Accordingly, stamps (not shown) can hung on the first and second disks 32, 31 and are received in the first and second recesses 322, 312.

Figure 5:
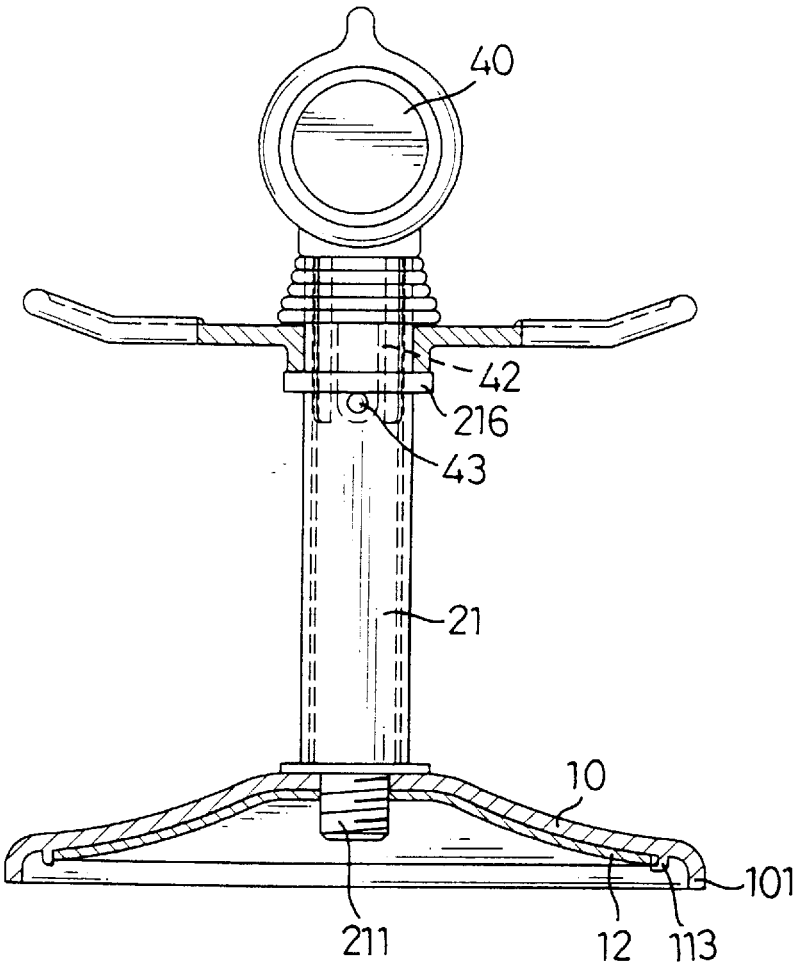
FIG. 5 is a side elevational view, partly in section, of another embodiment of the ink stamp rack in accordance with the present utility model.

Please refer to FIG. 5, the ink stamp rack is also to be used by directly engaging the cap 40 to the first end of the first post 21 with the second protrusion 43 extending through the first hole 218 of the first post 21.

Although the utility model has been explained in relation to its preferred embodiment, it is to be understood that many other possible modifications and variations can be made without departing from the spirit and scope of the utility model as hereinafter claimed.

What is claimed is:

1. A stamp rack comprising:

a base having a first central hole defined therethrough and a skirt portion extending downwardly from a periphery thereof, a first post having a first end and a second end which has a annular flange extending radially therefrom and an engaging rod extending longitudinally therefrom for being received in said first central hole, said first post having a first flange extending radially from a periphery thereof near said first end of said first post and a first hole defined through said first post 21 beneath said first flange;

a first disk having a second central hole defined therein so as to be mounted to said first end of said first post and supported by said first flange, a plurality of first recesses defined in said first disk along a periphery of said first disk;

a second post having a first end and a second end which has a first protrusion extending radially therefrom so as to extend through said first hole of said fist post via said first end of said first post, said first end of said second post having a second flange extending radially therefrom;

a second disk having a third central hole defined therein so as to be mounted to said first end of said second post and supported by said second flange, a plurality of second recesses defined in said second disk along a periphery of said second disk, and a cap mounted to said first end of said second post to position said second disk.

2. The stamp rack as claimed in claim 1 wherein said engaging rod has threaded portion defined in an outer periphery thereof and an inner plate is disposed to a bottom of said base, said inner plate has a central threaded hole defined therethrough such that said threaded portion of said engaging rod is engaged with said central threaded hole of said inner plate.

3. The stamp rack as claimed in claim 1 wherein said skirt portion has at least one protrusion extending inwardly and radially therefrom and said inner plate has a notch defined in an outer periphery thereof such that said protrusion is received in said notch.

4. The stamp rack as claimed in claim 1 wherein said second post has a second hole defined therethrough beneath said second flange and said cap has a second protrusion extending radially therefrom so as to extend through said second hole of said second post.

5. The stamp rack as claimed in claim 1 wherein each of said first recesses is a substantially Y-shaped recess.

6. The stamp rack as claimed in claim 1 wherein each of said second recesses is a substantially Y-shaped recess.

* * * * *